US007857146B2

(12) United States Patent
Disch et al.

(10) Patent No.: US 7,857,146 B2
(45) Date of Patent: Dec. 28, 2010

(54) DISH CARRIER FOR DISH WASHERS

(75) Inventors: Harald Disch, Elzach (DE); Werner Neumaier, Offenburg (DE); Jürgen Litterst, Appenweier (DE)

(73) Assignee: Premark Feg L.L.C., Wilmington, DE (US)

( * ) Notice: Subject to any disclaimer, the term of this patent is extended or adjusted under 35 U.S.C. 154(b) by 317 days.

(21) Appl. No.: 11/300,594

(22) Filed: Dec. 15, 2005

(65) Prior Publication Data

US 2006/0157430 A1 Jul. 20, 2006

(30) Foreign Application Priority Data

Dec. 16, 2004 (DE) ..... 10 2004 061 181

(51) Int. Cl.
*A47G 19/08* (2006.01)

(52) U.S. Cl. ..... 211/41.3

(58) Field of Classification Search ..... 211/41.3, 211/41.1, 41.2, 41.6, 59.4, 1.56; 198/803.14; 134/72; D6/528, 462

See application file for complete search history.

(56) References Cited

U.S. PATENT DOCUMENTS

| | | | | |
|---|---|---|---|---|
| 465,070 | A * | 12/1891 | Trew | 220/572 |
| 499,951 | A * | 6/1893 | Baird | 220/572 |
| 1,452,418 | A * | 4/1923 | Cunneen | 211/41.3 |
| D165,216 | S * | 11/1951 | Blakeslee | D32/55 |
| 2,667,262 | A * | 1/1954 | Davis | 198/803.13 |
| 2,840,227 | A * | 6/1958 | Federighi et al. | 198/867.14 |
| 2,841,288 | A * | 7/1958 | Field et al. | 211/41.4 |
| 2,936,898 | A * | 5/1960 | Miguez | 211/41.3 |
| 3,029,927 | A * | 4/1962 | Farwell | 198/464.4 |
| 3,044,601 | A * | 7/1962 | Ellis | 198/803.13 |
| 3,206,005 | A * | 9/1965 | Lyman | 198/867.14 |
| D217,491 | S * | 5/1970 | Wooters | D32/55 |
| 4,183,437 | A | 1/1980 | Crawford et al. | |
| 4,228,813 | A | 10/1980 | Noren | |
| 4,317,514 | A * | 3/1982 | Noren | 198/803.13 |
| 4,592,471 | A * | 6/1986 | Bross | 211/41.2 |
| 5,217,121 | A * | 6/1993 | Walker | 211/41.1 |
| 5,332,105 | A | 7/1994 | Stanfield | |
| D416,364 | S * | 11/1999 | Newhall | D32/55 |
| 5,988,777 | A * | 11/1999 | Schoeller | 312/9.58 |
| 6,364,130 | B2 * | 4/2002 | Wright | 211/41.3 |
| 7,344,036 | B2 * | 3/2008 | Jerstroem et al. | 211/41.6 |
| 2001/0047968 | A1 * | 12/2001 | Wright | 211/41.3 |
| 2006/0157430 | A1 * | 7/2006 | Disch et al. | 211/41.3 |
| 2006/0180179 | A1 * | 8/2006 | Roderer et al. | 134/18 |
| 2006/0213543 | A1 * | 9/2006 | Litterst et al. | 134/103.2 |

FOREIGN PATENT DOCUMENTS

| | | |
|---|---|---|
| CN | 2232717 Y | 8/1996 |
| CN | 2364841 Y | 2/2000 |
| CN | 2430939 Y | 5/2001 |
| DE | 92 12 169 U1 | 1/1993 |

(Continued)

*Primary Examiner*—Sarah Purol
(74) *Attorney, Agent, or Firm*—Lowe, Hauptman, Ham & Berner, LLP (ITW)

(57) ABSTRACT

In a dish carrier for dishwashers, in addition to lower supporting surfaces (8) and upper supporting surfaces (10), at least one upper extra supporting surface (34) which is offset forwards and/or upwards relative to the upper supporting surfaces is provided in compartments (22) for accommodating items (12, 14) to be washed in order to hold relatively flat items to be washed, for example trays (14), approximately parallel to deeper items which are to be washed, for example soup plates (12).

12 Claims, 5 Drawing Sheets

FOREIGN PATENT DOCUMENTS

| | | | |
|---|---|---|---|
| DE | 102004061181 | A1 | 6/2006 |
| FR | 2171858 | A | 9/1973 |
| JP | 10295613 | A | 11/1998 |
| JP | 2004194830 | A | 7/2004 |

* cited by examiner

DISH CARRIER FOR DISH WASHERS

RELATED APPLICATIONS

The present application is based on, and claims priority from, German Application Number 10 2004 061 181.5, filed Dec. 16, 2004, the disclosure of which is hereby incorporated by reference herein in its entirety.

FIELD OF THE INVENTION

The discosure relates to a dish carrier for dishwashers.

BACKGROUND OF THE INVENTION

The discosure relates in particular to dish carriers in the form of belts in commercial flight-type dishwashers, as are used in restaurants, pubs, canteens and similar facilities. Flight-type dishwashers or flight-type warewashers are so called because they wash not only dishes but also other articles which are used in kitchens and for consuming food and drinks, for example trays for carrying dishes. In this case, the dish carrier is a belt, usually in the form of a multisection chain-like belt which has supporting fingers between which the dishes or trays can be placed on their edges in order to be transported through the flight-type dishwasher.

However, the discosure also relates to dish carriers in the form of a rack in which dishes can be put on their edges and which is designed for use in rack-conveyor dishwashers or for use in batch dishwashers. A transporting apparatus, for example a belt or rollers, is provided in rack-conveyor dishwashers, and the dish carrier can be put on this transporting apparatus in order to be transported through the rack-conveyor dishwasher. This type of rack-conveyor dishwasher or rack-conveyor warewasher is used commercially in restaurants, pubs, canteens and similar facilities.

The discosure also relates to batch dishwashers which are used commercially, for example in restaurants, pubs, canteens and similar facilities. They are also called batch warewashers. This type of dishwasher may be an under-counter dishwasher (under-counter warewasher) or a top-counter dishwasher (top-counter warewasher) or a hood-type dishwasher (hood-type warewasher).

Furthermore, the discosure also relates to dish carriers for domestic dishwashers.

In the known dish carriers of the above-described types, the supporting surfaces which hold the dishes in the dish carrier in an obliquely upright position are uniformly distributed. In the dish carrier, dishes of large height (depth) and small diameter or small width, for example soup plates, are overreached and largely covered by other dishes or trays of low height (depth) but greater length or larger width and are thus screened from upper nozzles which spray cleaning water or washwater downwards onto the tray and onto the dish from above. As a result, the jets of water cannot directly strike the covered dishes so that these covered dishes are only inadequately cleaned or very large amounts of water and long washing times are required. A situation such as this is illustrated in FIG. 1 of the attached drawings. The more oblique position of flat trays by comparison with plates also causes the plates to undesirably screen these trays from jets of water which are sprayed from lower nozzles upwards onto the plates and trays from below.

FIG. 1 shows a section of a known dish carrier 2 in the form of an endless conveyor belt of a flight-type dishwasher. The dish carrier has a multiplicity of compartments 22 which are open at the top, are arranged one behind the other in the direction of movement of the belt and extend transversely thereto. The compartments 22 are formed by a multiplicity of supporting elements 4 which are arranged one behind the other in a number of longitudinal rows in the direction of movement of the belt and in a multiplicity of transverse rows at a distance next to one another in the manner of a chain link, and are connected to one another. The dishes stand obliquely on their edges in the compartments 22 on a base surface 6 and are supported in the longitudinal direction of the conveyor belt at lower supporting surfaces 8 and at upper supporting surfaces 10 of the supporting elements 4, these upper supporting surfaces being arranged higher than said lower supporting surfaces. The upper supporting surfaces 10 point in one longitudinal direction and the lower supporting surfaces 8 point in the opposite longitudinal direction. FIG. 1 shows a plate 12 and a tray 14 on the dish carrier 2. The tray 14 overreaches and covers the plate 12, because the height 16 of the tray is smaller than the height 18 of the plate and because the width of the tray 14 is greater than the diameter or the width of the plate 12. As a result, the tray 14 overreaches and conceals the plate 12.

It's desirable that all of the articles to be washed (items to be washed) can be cleaned well and with as little washwater or detergent as possible in a short time, even if the articles to be washed have different heights and different external circumferential dimensions.

SUMMARY OF THE INVENTION

An embodiment of the invention provides for the compartments of the dish carrier to have, in addition to lower supporting surfaces and upper supporting surfaces, at least one upper extra supporting surface which is offset forwards and/or upwards relative to the upper supporting surfaces and holds flat items to be washed, for example trays, roughly parallel to higher items to be washed, for example soup plates.

BRIEF DESCRIPTION OF THE DRAWING

Ebodiments of the invention will be described in the text which follows with reference to the attached drawings. In the drawings.

DETAILED DESCRIPTION OF THE EMBODIMENTS

Figure 1:
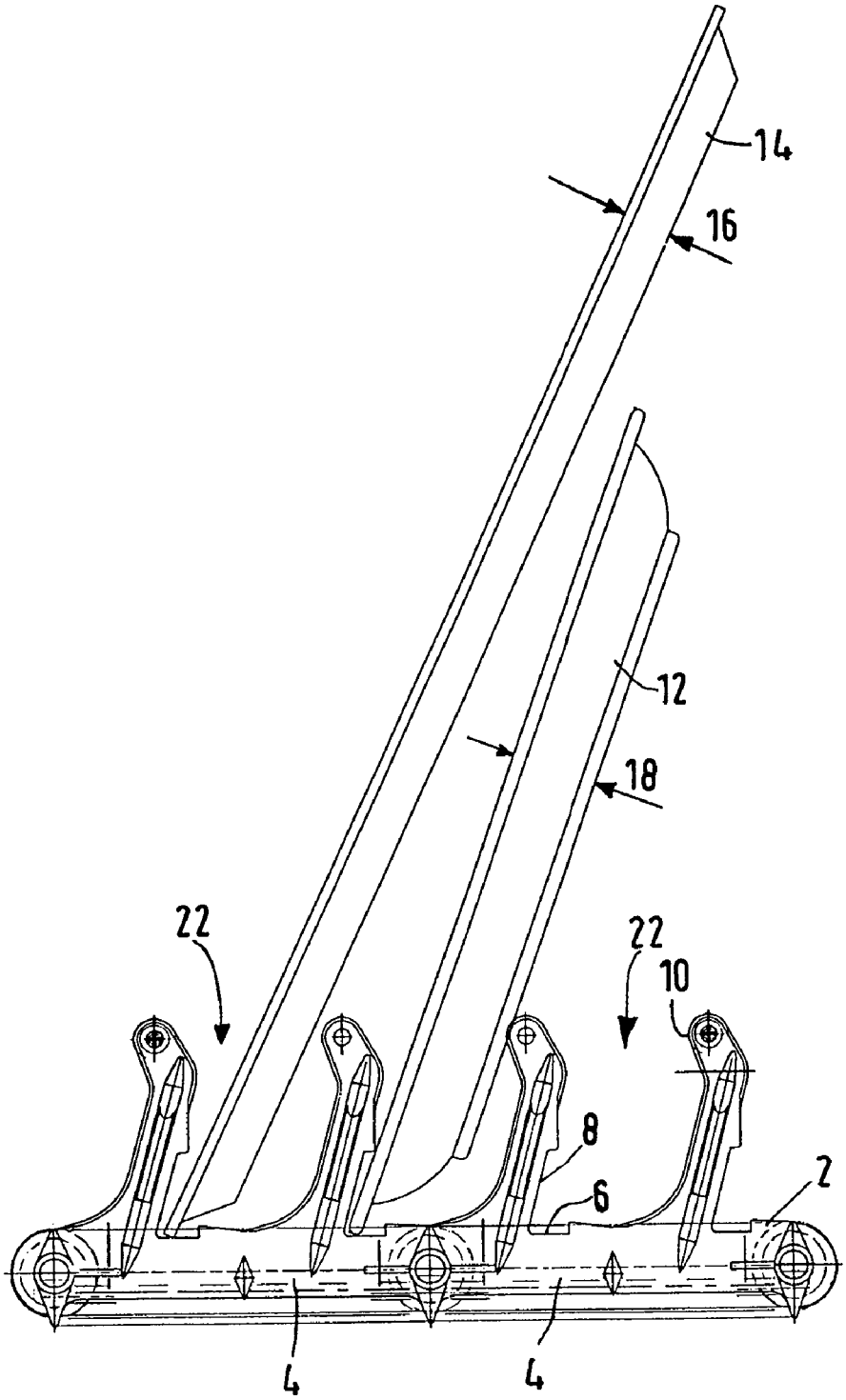
FIG. 1 PRIOR ART
FIG. 1 shows a side view of a section of a dish carrier in the form of a dish conveyor belt of a flight-type dishwasher according to the prior art.
Figure 2:
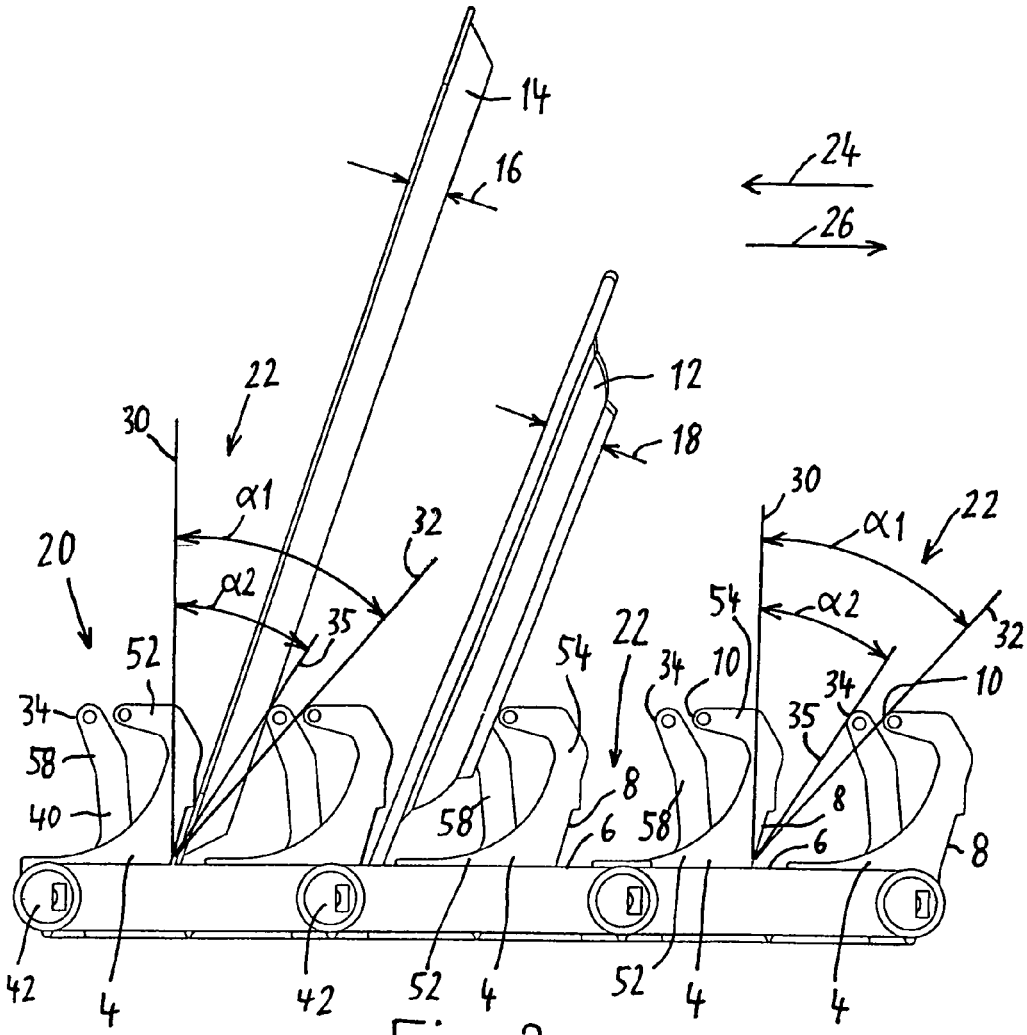
FIG. 2 shows a side view of a section of a dish carrier in the form of a conveyor belt of a flight-type dishwasher according to an embodiment of the invention.
Figure 5:
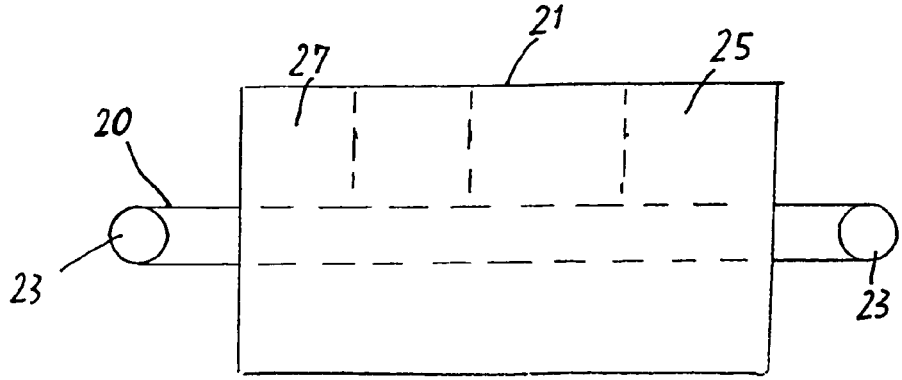
Figure 3:
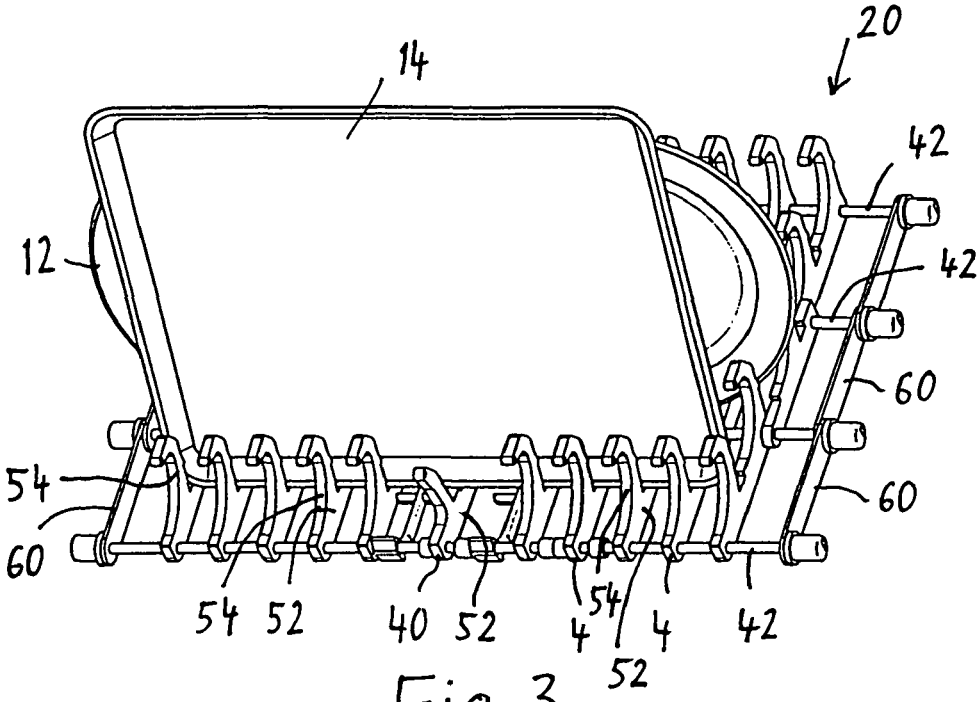
FIG. 3 shows a perspective view of the section of the dish carrier from FIG. 2 drawn on a different scale.
Figure 4:
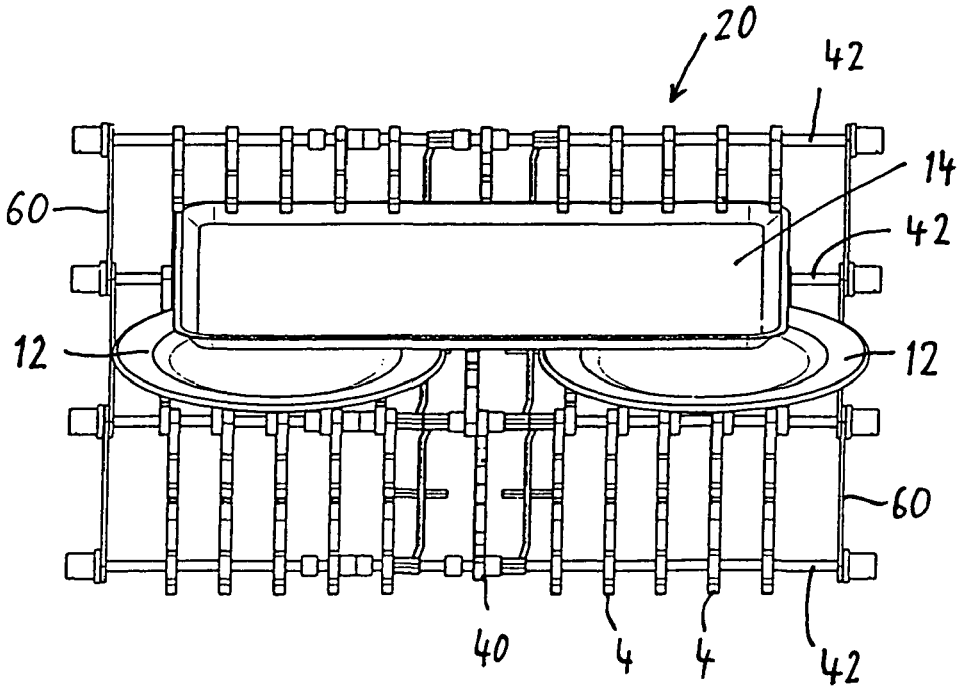
FIG. 4 shows a plan view of the dish carrier from FIGS. 2 and 3, FIG. 5 schematically shows a side view of a flight-type dishwasher according to an embodiment of the invention having a dish carrier according to FIGS. 2, 3 and 4.

FIGS. 2, 3 and 4 show a section of a dish carrier 20 in the form of an endless dish conveyor belt of a flight-type dishwasher 21, as shown schematically in FIG. 5 by way of example. The dish carrier 20 runs over wheels or rollers 23 and transports the items 12, 14 to be washed through at least one, preferably a number of, cleaning chamber(s) 25 and at least one clear-rinsing chamber 27.

The dish carrier 20 has a multiplicity of compartments 22 which are arranged one behind the other in a longitudinal direction 24 of the conveyor belt of the dish carrier 20 and transverse to this longitudinal direction 24, and are open at the top in order to insert obliquely on their edges the items to be washed, for example plates 12 and trays 14. The compartments 22 are formed by a multiplicity of supporting elements 4 which are arranged one behind the other in a number of longitudinal rows in the manner of a chain link and connected to one another in an articulated manner, and are arranged in a number of transverse rows at a distance from one another and likewise connected to one another.

As seen transverse to a longitudinal direction 24, on the supporting elements 4 for holding the items 12, 14 to be washed, each compartment 22 has base surfaces 6 arranged aligned with one another, lower supporting surfaces 8 which are arranged aligned with one another, extend upwards from the base surfaces 6 and point in an opposite longitudinal direction 26, and also upper supporting surfaces 10 which are aligned with one another, point in one longitudinal direction 24, are higher than the lower supporting surfaces 8 and are set back in the opposite longitudinal direction 26 by a first opening angle $\alpha 1$. The opening angle $\alpha 1$ is formed by a theoretical vertical plane 30, extending transverse to the longitudinal directions 24, 26, at the lower supporting surfaces 8 and a theoretical straight first connecting line 32 which extends from the angle vertex at the lower supporting surfaces 8 up to beyond the upper supporting surfaces 10 of the compartment 22 in question.

As a result, the compartments 22 and the items 12, 14 to be washed are inclined rearwards in the opposite longitudinal direction 26. In accordance with the preferred embodiment, one longitudinal direction 24 is the direction of movement in which the dish carrier 20 transports the items 12, 14 to be washed through the flight-type dishwasher 21. The direction of transport could also be reversed.

Each of the compartments 22 is provided with at least one offset upper extra supporting surface 34 which is arranged between a number of adjacent first upper supporting surfaces 10 on either side and points in the same direction as said supporting surfaces but is arranged such that it is offset forwards and/or is arranged offset upwards in one longitudinal direction 24 relative to the upper supporting surfaces 10 in such a way that a second opening angle $\alpha 2$ is formed which is smaller than the first opening angle $\alpha 1$ defined by the upper supporting surfaces 10. However, the smaller opening angle $\alpha 2$ is large enough to accommodate flat items 14, for example trays, to be washed and has a lower height 16 than the maximum height 18 of the items 12 to be washed, which can be supported by the upper supporting surfaces 10. In this case, the term "height" 16 and/or 18 denotes the height of the item to be washed when said item is lying horizontally. As an example of an item to be washed, FIG. 2 shows a tray 14 with a height 16 and a soup plate 12 with a height 18. The second opening angle $\alpha 2$ is formed between the theoretical vertical plane 30 and a theoretical straight second connecting line 35 which extends from the vertex of the first opening angle $\alpha 1$ at the lower supporting surfaces 8 up to beyond the offset upper extra supporting surface 34.

The offset upper extra supporting surface 34 is formed on an extra supporting element 40 which can also have a lower supporting surface 8 and a base surface 6. The supporting elements 4 and extra supporting elements 40 are connected to one another by rods 42.

The supporting elements 4 are each preferably a single-piece part and each have a foot part 52 and at least one, preferably two, supporting finger(s) 54 which extend(s) upwards from the foot part 52. The foot part 52 forms the base surface 6. In each compartment 22, a supporting finger 54 which is at the front in one longitudinal direction 24 forms the lower supporting surface 8, and the supporting finger 54 which is at the rear opposite this direction of movement 24 forms the upper supporting surface 10.

The extra supporting element 40 is preferably likewise a single-piece part having a foot part 52 and at least one, preferably two, extra supporting finger(s) 58 which project(s) upwards from the foot part 52. Each compartment 22 has one supporting finger 58 which is formed by an extra supporting element 40 and is at the front in relation to one longitudinal direction 24, and one rear extra supporting finger 58 which is arranged at a distance from the said front supporting finger. The foot parts 52 of the extra supporting elements 40 each form a base surface 6, and the extra supporting fingers 58 are provided with the lower supporting surface 8 at their lower end, which points rearwards, and are provided with the offset upper extra supporting surface 34 at their upper end, which points forwards.

The extra supporting element 40 having the offset upper extra supporting surface 34 is preferably arranged in the middle of the compartment in relation to the width of the compartments 22, transverse to the longitudinal directions 24, 26, as shown in FIGS. 3 and 4. Two or more extra supporting elements 40 can be arranged in each compartment 22.

As shown in particular in FIGS. 3 and 4, the rods 42 can be chain-connected to one another in an articulated manner by connecting links 60 on both longitudinal sides of the dish carrier.

Figure 6:
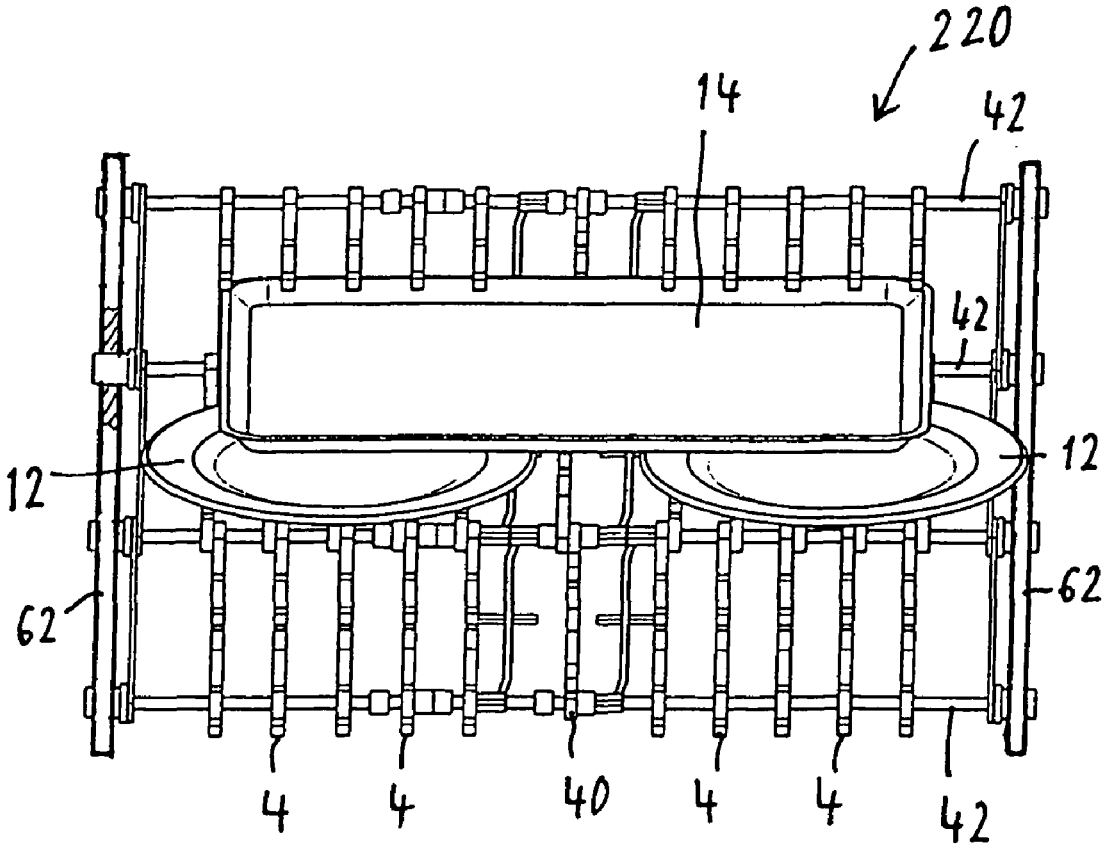
FIG. 6 shows a plan view of a dish carrier similar to the dish-carrier section from FIG. 4, but in the form of a dish rack for a rack-conveyor dishwasher or for a dishwasher in the form of a batch dishwasher.

FIG. 6 shows a plan view of a dish carrier 220 according to an embodiment of the invention which is identical to the section, illustrated in FIGS. 2-4, of a conveyor belt in the form of a dish carrier, with the exception that this section or dish carrier 220 has on both longitudinal sides a connecting bracket 62 which extends over the entire length in the longitudinal directions 24 and 26, connects the rods 42 to one another and thus prevents the possibility of the rods 42 moving relative to one another in the manner of a link chain. As a result, the dish carrier 220 forms a rigid dish rack which can be placed onto a transporting apparatus of a rack-conveyor dishwasher in order to transport items to be washed through this rack-conveyor dishwasher. According to other embodiments, the dish carrier 220 in the form of a rack can also be designed for use in a dishwasher which is in the form of a batch dishwasher (batch warewasher). The batch dishwasher can be an under-counter dishwasher (under-counter warewasher), a top-counter dishwasher (top-counter warewasher) or a hood-type dishwasher (hood-type warewasher).

Figure 7:
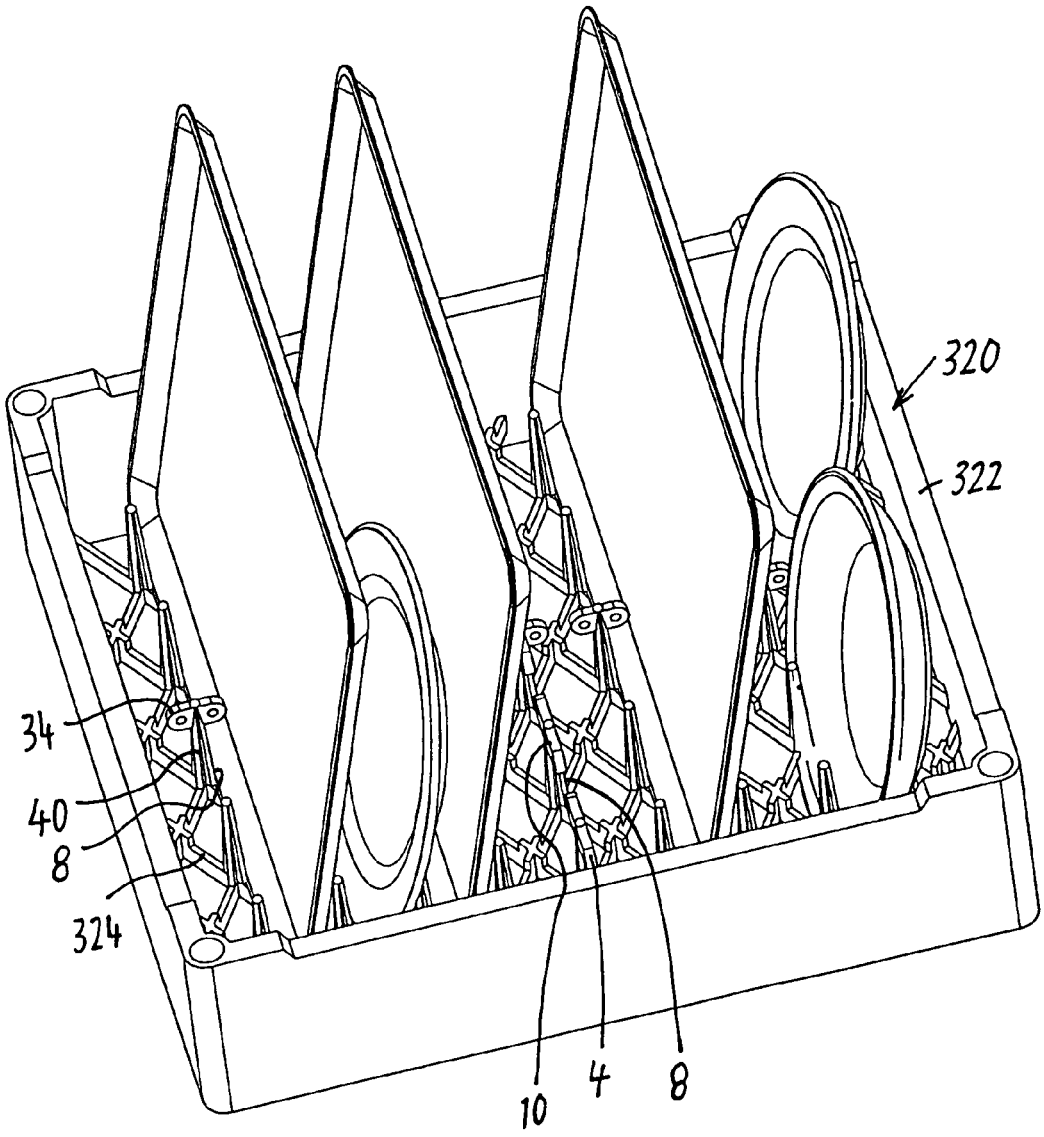
FIG. 7 shows a perspective plan view of a further dish rack according to an embodiment of the invention.

FIG. 7 shows a dish rack 320 for a rack-conveyor dishwasher, which dish rack has a frame 322 and a grid-like open base 324. Supporting elements 4, which have lower supporting surfaces 8 and upper supporting surfaces 10 of the type described above, and extra supporting elements 40, which have extra supporting surfaces 34 and preferably also lower supporting surfaces 8 of the type described above, project upwards from the base 324 in order to hold items to be washed, in particular plates 12 and trays 14, in an upright or obliquely upright position.

An embodiment of invention also includes the possibility of providing in the compartments 22, in addition to the upper offset extra supporting surface 34, a second upper offset extra supporting surface, which is directed opposite the said upper offset extra supporting surface, for dishwashers in which the item to be washed can optionally be positioned inclined in one or the other longitudinal direction.

The invention claimed is:

1. A dish carrier for dishwashers, comprising:

a plurality of fingers arranged in rows, said rows being arranged one behind the other in a longitudinal direction of the dish carrier and extending in a transverse direction of the dish carrier;

a multiplicity of compartments arranged one behind the other in the longitudinal direction of the dish carrier, each compartment being defined between two successive rows of the fingers and formed with a top opening to receive items to be washed;

wherein said fingers comprise first fingers having upper supporting surfaces which define relative to a theoretical vertical plane a first opening angle at which the items to be washed are held obliquely upright in the compartments, and at least a second finger having an offset upper supporting surface which defines relative to the theoretical vertical plane a second opening angle which is smaller than the first opening angle so that the items to be washed are thereby held in the respective compartment in a more upright position by the offset upper supporting surface than by the upper supporting surfaces, wherein the second finger is arranged in the same row together with a number of said first fingers.

2. A dish carrier for dishwashers, comprising:

a plurality of fingers arranged in rows, said rows being arranged one behind the other in a longitudinal direction of the dish carrier and extending in a transverse direction of the dish carrier;

a multiplicity of compartments arranged one behind the other in the longitudinal direction of the dish carrier, each compartment being defined between two successive rows of the fingers and formed with a top opening to receive items to be washed;

wherein said fingers comprise first fingers having upper supporting surfaces which define relative to a theoretical vertical plane a first opening angle at which the items to be washed are held obliquely upright in the compartments, and at least a second finger having an offset upper supporting surface which defines relative to the theoretical vertical plane a second opening angle which is smaller than the first opening angle so that the items to be washed are thereby held in the respective compartment in a more upright position by the offset upper supporting surface than by the upper supporting surfaces, wherein the second finger is arranged in the middle of the same row together with a number of said first fingers.

3. The dish carrier for dishwashers according to claim 1, wherein said dish carrier is a conveyor belt for a flight-type dishwasher.

4. The dish carrier for dishwashers according to claim 1, wherein said dish carrier is a conveyor rack for a rack-conveyor dishwasher.

5. The dish carrier for dishwashers according to claim 1, wherein said dish carrier is a dish rack for a batch dishwasher.

6. The dish carrier for dishwashers according to claim 1, wherein said fingers are connected one to another by transverse rods in the transverse direction.

7. The dish carrier for dishwashers according to claim 6, wherein said transverse rods are connected one to another by longitudinal rods in the longitudinal direction.

8. The dish carrier for dishwashers according to claim 6, wherein said fingers have foot parts and supporting parts which project upwards from the foot parts and define the upper supporting surfaces and the offset upper supporting surface, and the supporting parts of the fingers are fixed to the respective transverse rods.

9. The dish carrier for dishwashers according to claim 6, wherein said fingers have foot parts and supporting parts which project upwards from the foot parts and define the upper supporting surfaces and the offset upper supporting surface, the supporting parts of the fingers are fixed to the respective transverse rods, and said offset upper supporting surface and said upper supporting surfaces are at top ends of said supporting parts, respectively, and are arranged at different distances from the theoretical vertical plane to define the different first and second opening angles.

10. The dish carrier for dishwashers according to claim 7, wherein said fingers have foot parts and supporting parts which project upwards from the foot parts and define the upper supporting surfaces and the offset upper supporting surface, the supporting parts of the fingers are fixed to the respective transverse rods, and said offset upper supporting surface and said upper supporting surfaces are at top ends of said supporting parts, respectively, and are arranged at different distances from the theoretical vertical plane to define the different first and second opening angles.

11. A dishwasher, comprising:

a dish carrier;

a set of rollers mounted on the dish carrier for transporting items to be washed along a transportation path having an upstream side and a downstream side;

a number of cleaning chambers arranged at the upstream side of the transportation path; and at least one clear-rinsing chamber arranged at the downstream side of the transportation path, wherein said dish carrier comprises:

a plurality of fingers arranged in rows, said rows being arranged one behind the other in a longitudinal direction of the dish carrier and extending in a transverse direction of the dish carrier;

a multiplicity of compartments arranged one behind the other in the longitudinal direction of the dish carrier, each compartment being defined between two successive rows of the fingers and formed with a top opening to receive the items to be washed;

wherein said fingers comprise first fingers having upper supporting surfaces which define relative to a theoretical vertical plane a first opening angle at which the items to be washed are held obliquely upright in the compartments, and at least a second finger having an offset upper supporting surface which defines relative to the theoretical vertical plane a second opening angle which is smaller than the first opening angle so that the items to be washed are thereby held in the respective compartment in a more upright position by the offset upper supporting surface than by the upper supporting surfaces, wherein the second finger is arranged in the same row together with a number of said first fingers.

12. The dishwasher according to claim 11, being a flight-type dishwasher, wherein the dish carrier is a conveyor belt.

* * * * *